US009739139B2

(12) United States Patent
Morrison et al.

(10) Patent No.: US 9,739,139 B2
(45) Date of Patent: Aug. 22, 2017

(54) INTERVENTION OPERATIONS WITH HIGH RATE TELEMETRY

(71) Applicant: Schlumberger Technology Corporation, Sugar Land, TX (US)

(72) Inventors: Richard Morrison, Sugar Land, TX (US); Michael H. Kenison, Richmond, TX (US); Bonnie Powell, Perth (AU)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 96 days.

(21) Appl. No.: 14/402,079

(22) PCT Filed: May 15, 2013

(86) PCT No.: PCT/US2013/041048

§ 371 (c)(1),
(2) Date: Nov. 18, 2014

(87) PCT Pub. No.: WO2013/173402

PCT Pub. Date: Nov. 21, 2013

(65) Prior Publication Data

US 2015/0130627 A1 May 14, 2015

Related U.S. Application Data

(60) Provisional application No. 61/648,883, filed on May 18, 2012.

(51) Int. Cl.
*E21B 47/12* (2012.01)
*E21B 44/00* (2006.01)
(Continued)

(52) U.S. Cl.
CPC ..... *E21B 47/122* (2013.01); *E21B 44/00* (2013.01); *E21B 47/12* (2013.01); *E21B 47/022* (2013.01); *E21B 47/14* (2013.01); *E21B 47/16* (2013.01)

(58) Field of Classification Search
None
See application file for complete search history.

(56) References Cited

U.S. PATENT DOCUMENTS 6,177,882 B1 * 1/2001 Ringgenberg ..... E21B 47/122 324/342
2004/0124009 A1 * 7/2004 Hoteit ..... G06N 7/005 175/25

(Continued)

FOREIGN PATENT DOCUMENTS

EA 007847 B1 2/2007
EA 200870355 A1 2/2009

(Continued)

OTHER PUBLICATIONS

International Search Report and the Written Opinion for International Application No. PCT/US2013/041048 dated Sep. 19, 2013.

*Primary Examiner* — Leon-Viet Nguyen
(74) *Attorney, Agent, or Firm* — Michael L. Flynn; Jody Lynn DeStefanis; Robin Nava

(57) ABSTRACT

A technique facilitates an improved operation of a tool, such as a downhole tool. The tool is operated in a manner which provides a dynamic or cyclical loading. The dynamic or cyclical loading of the tool is sampled by a suitable sensing system at a frequency greater than the frequency of the dynamic or cyclical loading to collect detailed data on the dynamic or cyclical loading. The data is used to adjust the tool in a manner which improves operation of the tool. One (Continued)

technique for adjusting the tool is changing the dynamic or cyclical loading of the tool by adjusting the frequency of the dynamic or cyclical loading.

19 Claims, 3 Drawing Sheets

(51) Int. Cl.

| | |
|---|---|
| *E21B 47/022* | (2012.01) |
| *E21B 47/16* | (2006.01) |
| *E21B 47/14* | (2006.01) |

(56) References Cited

U.S. PATENT DOCUMENTS

| | | | | |
|---|---|---|---|---|
| 2010/0300685 | A1* | 12/2010 | Del Campo | E21B 17/003 166/254.2 |
| 2012/0069708 | A1* | 3/2012 | Swett | B06B 1/0618 367/81 |
| 2013/0153227 | A1* | 6/2013 | Laird | E21B 29/002 166/301 |

FOREIGN PATENT DOCUMENTS

| | | | |
|---|---|---|---|
| RU | 2347268 | C2 | 2/2009 |
| RU | 95200 | U1 | 6/2010 |
| WO | 2013173402 | A1 | 11/2013 |

* cited by examiner

INTERVENTION OPERATIONS WITH HIGH RATE TELEMETRY

BACKGROUND

In many well applications, downhole tools operate with a cyclic characteristic. For example, some downhole tools are designed to create a cyclical axial impact force to facilitate axial movement of a tool string or to achieve another desired result. Other types of tools create vibrations which can be beneficial or detrimental to optimal operation of the tool depending on the vibration magnitude and frequency. For example, some tools have a resonant frequency which can be used to optimize performance of the tool, e.g. to extend the reach of a coiled tubing tool into a well. However, the resonant frequency can limit the operation and/or lifespan of the tool by creating detrimental forces acting on the tool.

SUMMARY

In general, a system and methodology are provided for improving the operation of a tool, such as a downhole tool. The tool is operated in a manner which provides a cyclical activity, e.g. cyclical loading. The cyclical activity is sampled at a frequency greater than the frequency of the cyclical activity to collect data on the cyclical activity. The data is used to adjust the tool in a manner which improves operation of the tool. For example, the cyclical activity of the tool can be adjusted by changing the frequency of the cyclical activity or by making other suitable changes to the cycling of the tool.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
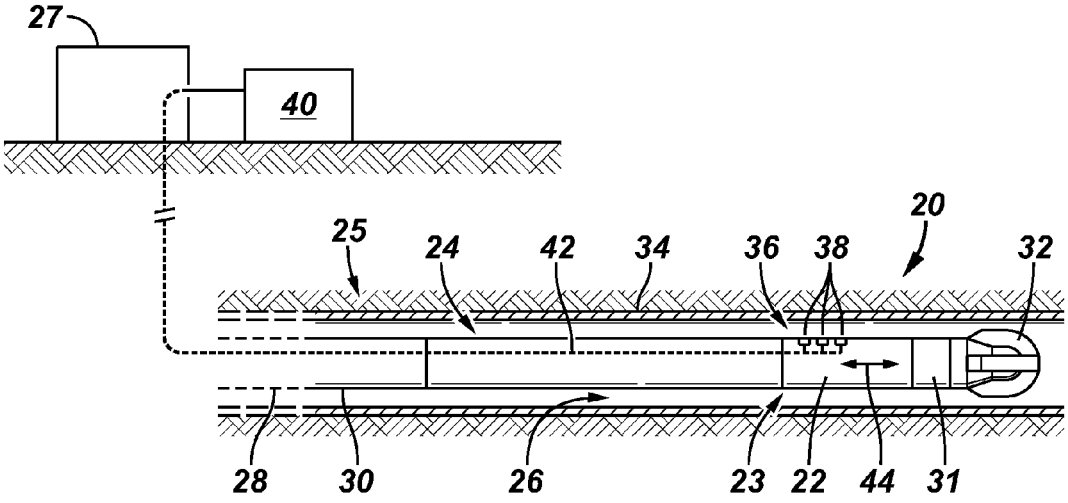
FIG. 1 is a schematic illustration of an intervention system deployed downhole into a deviated wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology for improving the operation of a tool, such as a downhole tool. Many types of tools have cyclical or dynamic operating characteristics, such as vibration and/or reciprocation, which create cyclical loading and acceleration of the tool. Sometimes the cyclical loading is part of the intentional design of the tool, and sometimes the cyclical loading is a byproduct of the tool operation. In embodiments described herein, the cyclical loading comprises one or more cycles; and the cyclical loading can be sampled at a frequency greater than the frequency of the cyclical loading to enable detailed collection of data on the cyclical loading. It should be noted that the data may be collected on other cyclical characteristics, such as acceleration.

In a variety of applications, the cyclical or dynamic loading is sampled at a substantially higher frequency than the frequency of the cyclical loading to facilitate collection of a variety of desirable data on the tool loading, e.g. peak loading, resonant frequency, and other types of data. The data may then be used to adjust the tool to improve operation of the tool. In some applications, the operation of the tool is adjusted to change the cyclical loading of the tool, e.g. to change the magnitude or the frequency of the cyclical loading, in a manner which improves operation of the tool.

In some embodiments, the system and methodology are designed for downhole, well related applications. For example, the system and methodology may be used in obtaining data on high rate downhole load measurements (e.g. force and/or torque measurements) and providing that data to the surface in real-time for processing to improve the downhole operation. By way of further example, the high rate downhole load measurements may be obtained for tools used in intervention operations, such as coiled tubing intervention operations. The high rate measurements provide a variety of useful data on coiled tubing operations and other operations compared with low rate, e.g. 1 Hz, measurements. In some applications, high rate measurement data may be obtained for load and/or acceleration measurements, however load measurements may be used independently to improve performance in many types of applications.

The term "high rate measurements" refers to sampling the cyclical or dynamic loading at a frequency greater than the frequency of the cyclical loading to collect detailed data, e.g. multiple data points, on each cycle of the cyclical loading. In some applications, the high rate measurements may be taken at a frequency substantially higher than the load (or acceleration) cycles of the tool. For example, sampling of the cyclical activity, e.g. cyclical loading, may be at a frequency at least about 2 to about 5 times the frequency of the cyclical activity. In other applications, sampling of the cyclical activity may be at least about 10 times the frequency of the cyclical activity. In this latter example: to measure the peak force of a signal based on cyclical loading of a tool at 10 Hz, a sampling frequency of at least 100 Hz would be selected to achieve the 10× ratio. It should be noted that in many applications determination of peak loading, via the high rate sampling, is more useful than determination of peak acceleration.

However, acceleration data may be useful to determine if a particular tool undergoing cyclical loading is in resonance. Additionally, acceleration data may provide information on whether something has happened, but such acceleration data often is more useful as qualitative data rather than quantitative data. Depending on the application, the acceleration data may be used as a qualitative indicator which signals the occurrence of a specific event, e.g. a perforating gun fires, a tool is jar actuated, a ball lands on a seat downhole, a mechanism shifts, or another event occurrence.

Referring generally to FIG. 1, an embodiment of a system 20 is illustrated as including a tool 22 which undergoes a cyclical activity, e.g. cyclical loading/cyclical acceleration, which is measured. In this embodiment, tool 22 is part of a bottom hole assembly 23 coupled into a tool string 24 and deployed in a wellbore 26. Tool string 24 may be part of an intervention assembly 25 extending from surface equipment 27. In some applications, wellbore 26 may be a deviated, e.g. horizontal, wellbore into which the tool 22 is delivered. Although tool 22 may be constructed for a variety of well and non-well related applications, many tools 22 are designed for well intervention applications. Examples of well intervention applications, include drilling related applications, deployment applications, perforating applications, treatment applications, and/or a variety of other well intervention applications.

The tool 22 and tool string 24 may be conveyed along wellbore 26 by a suitable conveyance 28, such as a coiled tubing or slickline conveyance 28. According to a specific example, conveyance 28 comprises coiled tubing 30 and the overall system 20 comprises tool string 24 which is part of coiled tubing intervention assembly 25. Depending on the application, bottom hole assembly 23 may comprise a cutting device 32 attached to tool 22 or formed as part of tool 22. Examples of cutting devices 32 include drilling bits for drilling wellbore 26 or milling bits for cutting through surrounding material, e.g. a surrounding casing 34. Tool 22 undergoes a cyclical activity, e.g. cyclical loading, which may be incidental to operation of the tool 22 or specifically designed into operation of the tool 22. By measuring and monitoring the cyclical activity, adjustments may be made to the operation of the tool 22 to enhance performance of the tool 22. Examples of adjustments include adjustments to the cyclical frequency, adjustments to the loading, repair or replacement of tool 22, or other appropriate adjustments.

Referring again to FIG. 1, a sensor system 36 having one or more sensors 38 may be used to monitor and collect data at a rate sufficient to evaluate a cyclical activity, e.g. a cyclical or dynamic loading, associated with the operation of tool 22 in the intervention operation or other operation. The sensor system 36 may be used to deliver data uphole to a control system 40, such as a surface-based computer control system, which may be part of surface equipment 27. In some applications, the sensor system 36 may be coupled with the control system 40 via a communication line 42, such as a fiber optic communication line or an electrical conductor communication line designed to convey data from the sensor system 36 to the control system 40 and/or vice versa. In a coiled tubing intervention application, the communication line 42 may be routed along an interior (e.g. an interior flow path) of the coiled tubing 30. In FIG. 1, the cyclical activity of tool 22 is represented by arrows 44 and the cyclical activity may comprise a vibration or reciprocal motion in an axial direction (or other direction), depending on the application and on the construction of tool 22.

Figure 2:
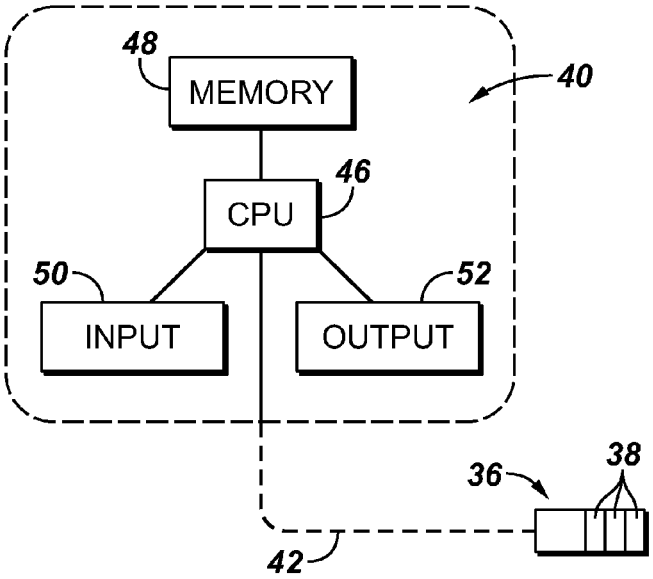
FIG. 2 is a schematic illustration of a control system designed to receive and process data on the cyclical loading of a tool, according to an embodiment of the disclosure.

Referring generally to FIG. 2, an example of control system 40 is illustrated. In this embodiment, the various data collected by sensors 38 may be output to control system 40 via communication line 42 and processed on control system 40. In some embodiments, the data is processed to construct control models and/or is subjected to modeling on the processor-based control system 40. By way of example, the sensors may be of the type designed to measure load, acceleration, and/or other parameters indicative of the cyclical motion of tool 22. The sensor data resulting from these measured parameters may be used to monitor/track in real-time the cyclical, e.g. reciprocating, motion at a substantially higher sampling rate than the frequency of the actual cyclic motion. The control system 40 may be designed to output data and/or to automatically control adjustment of the operation of tool 22 in a manner which improves operation of the tool 22.

As discussed above, control system 40 may be in the form of a computer-based system having a processor 46, such as a central processing unit (CPU). The processor 46 is operatively employed to intake and process data obtained from the sensor or sensors 38 of sensor system 36. The processor 46 also may be operatively coupled with a memory 48, an input device 50, and an output device 52. Input device 50 may comprise a variety of devices, such as a keyboard, mouse, voice recognition unit, touchscreen, other input devices, or combinations of such devices. Output device 52 may comprise a visual and/or audio output device, such as a computer display, monitor, or other display medium having a graphical user interface. Additionally, the processing may be done on a single device or multiple devices on location, e.g. a well site, away from the location, or with some devices located on location and other devices located remotely or with some devices locating downhole, such as devices utilized as part of the bottom hole assembly 23. Once the desired processing of data from sensors 38 is performed on control system 40, appropriate information may be output to output device 52 for review by an operator. The operator may then input instructions via input device 50 to adjust the operation of tool 22, e.g. the cyclical rate or the force output, based on the sensor data monitored, collected and processed. In a variety of applications, the processor 46 may be programmed to automatically take action, based on data from sensors 38, to improve the performance of tool 22. Depending on the application, processor 46 may be programmed with a variety of models or algorithms designed to optimize or otherwise enhance operation of tool 22. In an embodiment, the data processing may be performed downhole with a device as part of the bottom hole assembly 23 utilized for, in a non-limiting example, converting raw data to acceleration or force, for automatically deciding what portion of data to send uphole to the control system 40.

The adjustments to tool 22 based on data from sensor system 36 may take a variety of forms depending on the tool type, environment, and application. For example, high-frequency load and/or acceleration measurements obtained from sensors 38 may be used to optimize the performance of various tools 22 used for coiled tubing interventions or other operations.

By way of example, the data obtained from sensors 38 may be used to maintain resonant frequency. According to one embodiment, tool 22 illustrated in FIG. 1 is a mechanical vibration tool. The mechanical vibration tool 22 may be used to create a cyclic actuation, e.g. a cyclic loading, which helps advance movement of the tool 22. In coiled tubing intervention operations, the mechanical vibration of tool 22 may be used to extend the reach of coiled tubing 30 and tool 22 into the well, particularly along a horizontal or otherwise deviated section of the well.

In this type of application, the cyclical loading/mechanical vibration may be induced by a variety of mechanisms. For example, mechanical vibration may be induced by fluid pumped along an interior of coiled tubing 30 and through tool 22 in a manner which causes mechanical vibration in an axial direction and creates a nominally sinusoidal axial force, as represented by arrow 44. The axial force may be created, for example, by generating an impact load with an internal mass or by creating pressure pulses that indirectly result in a cyclical axial force acting on the tool 22 and thus on coiled tubing 30.

Because these types of tools generally have some combination of springs and masses to create the cyclical activity, there often is a natural resonant frequency at which the mechanical vibration is maximized. A measurement, e.g. a real-time measurement, of axial force and/or acceleration can be provided by sensor system 36 at a frequency substantially higher than the frequency of the cyclical activity. This data is then processed and used to ensure the system/tool 22 remains in resonance by, for example, varying the flow rate of fluid through the tool 22 or otherwise changing the frequency of the cyclical activity. As discussed above, the sampling rate of sensor system 36 is higher than the frequency of the mechanical vibration and often is substantially higher, e.g. at least about 2 to about 5 times and in some cases at least about 10 times the frequency of the cyclical activity of tool 22. This allows sensor system 36 to provide detailed data to control system 40 on the loading and/or acceleration of tool 22 as it vibrates in an axial direction. In other applications, the sensor data may be used for avoiding resonant frequencies to, for example, protect the tool 22 from undue wear.

Figure 3:
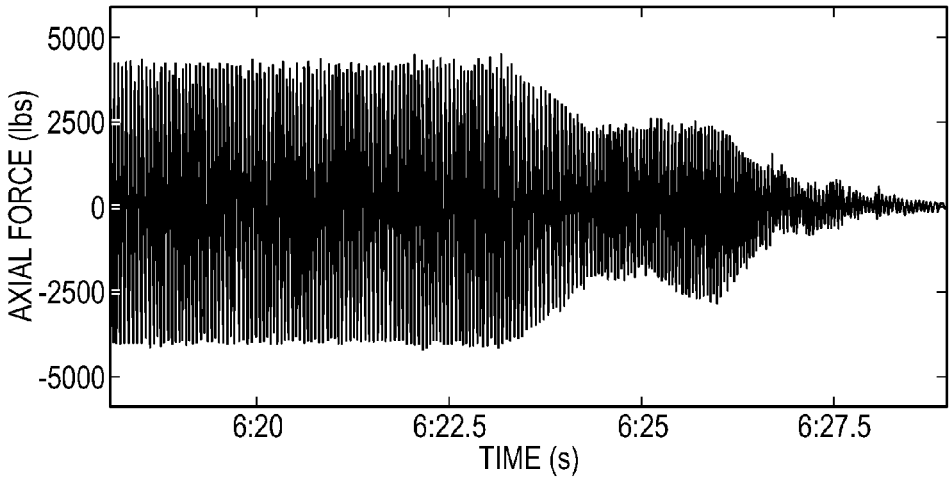
FIG. 3 is a graphical illustration of data plotted to show cyclical forces for a vibrating tool, according to an embodiment of the disclosure.

An example of the output from sensor system 36 is illustrated graphically in FIG. 3. In this example, a plot is provided showing high rate axial force data for a vibrating tool in which the axial vibration is induced by fluid flow moving through an interior flow path of the coiled tubing 30 and tool 22. The peak axial force is affected substantially as the flow rate of fluid and thus the induced vibration in tool 22 is changed over time. The data received from sensor system 36 may be monitored and collected by control system 40 to facilitate adjustment of the cyclical loading/mechanical vibration of tool 22 to a level, e.g. a resonant level, which facilitates increased movement and reach of the coiled tubing system along wellbore 26.

In another example, tool 22 comprises a jarring tool and the data obtained on the cyclical activity of the tool 22 is used to optimize jar preload. Jarring tools 22 create an axial impact force which may be rated as a multiple of the load applied to the jar before it actuates. In other words, if about 5000 pounds of tension are applied to a 4 to 1 jar, then the jar should deliver about 20,000 pounds of peak impact force to its attachment point. The amount of preload may be chosen or selected so that the peak force does not exceed the tensile limits of any component of tool 22 or associated equipment. For example, tool 22 may be used in bottom hole assembly 23, and the cyclical activity of tool 22, e.g. the cyclical jarring force, is limited so as to not exceed the tensile limits of any component in the bottom hole assembly 23. If, for example, a housing in the bottom hole assembly 23 is rated to 40,000 pounds and a 4 to 1 jar is used, a preload of 10,000 pounds may be set as a maximum so as to protect the housing.

Figure 4:
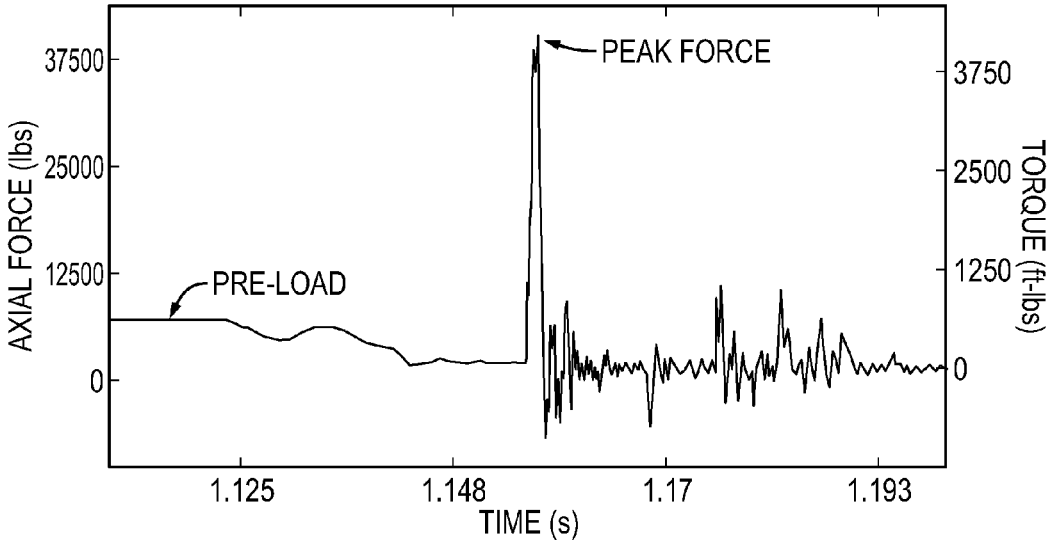
FIG. 4 is a graphical illustration of data plotted to show cyclical impact forces of a jarring tool, according to an embodiment of the disclosure.

In practice, the actual peak force may be substantially lower than the predicted value. By measuring the peak impact force in, for example, real-time, the amount of preload may be increased until the peak force approaches the tool limit, e.g. the tensile limit of tool 22 and its associated equipment. Thus, the cyclical activity may be adjusted based on the data from sensor system 36 to increase the peak force and to effectively improve or optimize the jarring operation. An example of adjusting the peak force to a more optimal level is illustrated graphically in FIG. 4. As illustrated, data provided to control system 40 from sensors 38 may be used to adjust the preload over time to optimize the peak force of the jarring tool 22, thus improving the jarring operation. In an embodiment, the tool 22 may comprise include an impact hammer and the operation may comprising an impact hammer operation.

In another tool optimization example, data supplied in real-time from system 36 may be used to prevent an undesirable result, such as motor stall. For example, in many coiled tubing intervention operations, the operation may be optimized by improving the rate of penetration of tool 22 and its cutting device 32 through a given material. In a specific example, the coiled tubing intervention operation involves a milling operation which benefits from an increased rate of penetration through the cement, hard fill, and other materials surrounding wellbore 26. The rate of penetration may be increased to some extent by increasing the set down weight on bottom hole assembly 23 and tool 22. The increased set down weight increases the contact force between the cutting device 32 and the material cut/milled by cutting device 32. However, too much set down weight may cause stalling of the bottom hole assembly mud motor 31 used to rotate cutting device 32. The mud motor 31 is provides rotational energy to the cutting device 32 by utilizing fluid flowing within the coiled tubing 30, as will be appreciated by those skilled in the art. If the mud motor stalls, the bit 32 stops turning and fluid bypasses the rotor of the mud motor. Repeated stalls may shorten the life of the mud motor and damage a sealing element of the mud motor. When the motor 31 stalls, the efficiency of the operation also decreases because the operator stops pumping fluid through the motor and pulls up before re-engaging the milling/cutting device 32.

Figure 5:
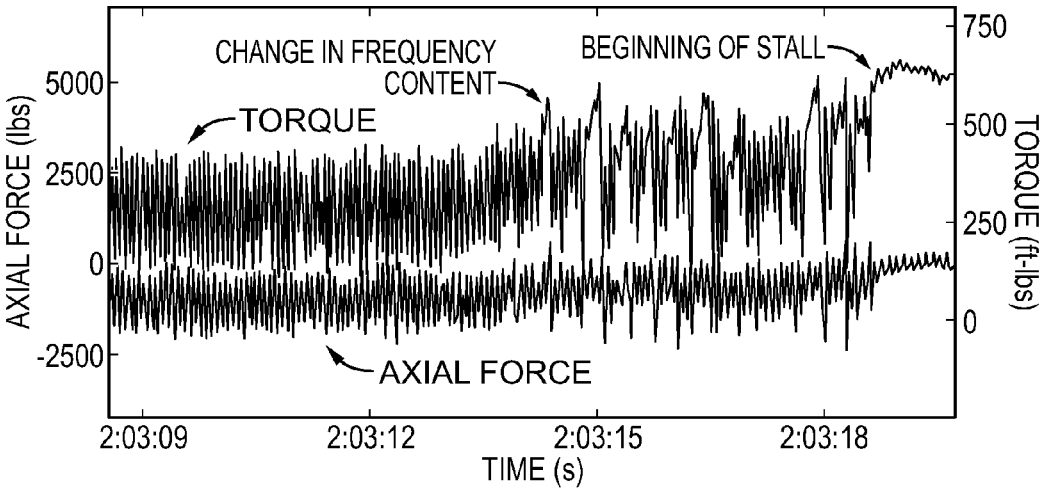
FIG. 5 is a graphical illustration of data plotted to show irregular frequency content of a torque signal for a cyclical tool, according to an embodiment of the disclosure.

By monitoring the cyclical activity of the downhole mud motor torque at a high rate in real-time via sensor system 36, the potential stall may be predicted. The control system 40 may be used to output this information to output device 52. The control system 40 also may be programmed to automatically intervene and take action by, for example, modifying the set down load or pump rate to effectively change the frequency of the cyclical torque output and to prevent stalling of the motor 31. In FIG. 5, a graphical representation provides a plot which illustrates how the irregular frequency content of the torque signal changes (low-frequency component introduced) before the stall occurs (flat region on graph). By monitoring and collecting data on the cyclical torque signal via sensor system 36, the potential for stalling may be substantially reduced. In this example, the sensors 38 may again be used to sample the signal at a much higher rate than the frequency at which the torque signal cycles, thus enhancing the information available for indicating potential motor stalling.

The sensor system 36 and control system 40 also may be used in a variety of applications for tool protection. The high frequency load measurements may be used to ensure that a tool does not exceed predetermined operating limits during a given operation.

In an example, tool 22 is a jarring tool and sensor system 36 is used to monitor peak jar force. The jarring tool 22 creates an impact force downhole in wellbore 26 that may be several times greater than the preload applied to the jar before it actuates. If the peak force exceeds the limit of a load bearing member in the bottom hole assembly 23 or other associated equipment, then a failure may occur. By monitoring the peak jar force at a high sampling rate in real time (e.g. a sampling rate at least about 10 times the jar cycle frequency), an operator and/or control system 40 may ensure that the tool limit is not exceeded regardless of the preload applied or the rating of the jar tool 22. During cycling of the jarring loads, if a jarring impact load approaches the predetermined limit of tool 22 (or associated equipment in the bottom hole assembly 23), an operator and/or control system 40 adjusts the cyclical loading by, for example, reducing the preload on subsequent jarring impacts. The adjustment is helpful in protecting the components of the bottom hole assembly 23 and also in maintaining operation of the jar tool 22 over many potential, successive jars that may be utilized in executing a jarring operation.

Another example of utilizing sensor system 36 in monitoring and collecting cyclical activity data at a high rate involves measurement of peak force during a perforation operation. In this example, tool 22 comprises a perforating tool which may be part of a bottom hole assembly, such as the bottom hole assembly 23, deployed on coiled tubing 30. When a perforating gun fires, the resulting pressure wave may create a very large axial force on perforating tool 22, on the bottom hole assembly 23, and on the corresponding coiled tubing 30. By measuring the axial force at a high rate and in real-time, data may be provided to control system 40 indicating whether the resulting load approaches or exceeds a load limit for the bottom hole assembly 23/perforating tool 22.

Figure 6:
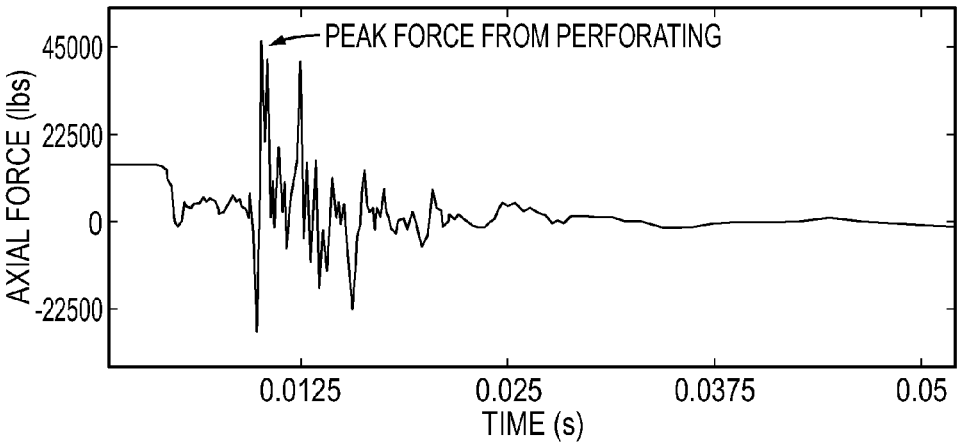
FIG. 6 is a graphical illustration of data plotted to show cyclical loading caused by shock from a perforating event, according to an embodiment of the disclosure.

Based on the data obtained from sensors 38 of sensor system 36, the cyclical activity of the perforating tool may be adjusted. In this application, that adjustment may comprise taking measures to reduce the impact force which occurs during future perforating runs in the same or in a similar well. For example, the shot density may be lowered or the perforated interval length may be decreased to reduce the peak loading which occurs during the load cycle following firing of the perforating tool 22. An example of cyclical loading caused by shock from a perforating operation is illustrated graphically in FIG. 6. As illustrated, data from sensors 38 provided to control system 40 indicates a peak force from perforating. This peak force data may be used to adjust subsequent perforating operations so that the peak force during the load cycle does not exceed tool limits of the bottom hole assembly 23 and/or the perforating tool 22. Such adjustment protects the tool 22 and associated equipment during future load cycles resulting from future perforating operations.

Another example of utilizing sensor system 36 in monitoring and collecting cyclical activity data at a high rate involves performance verification of tool 22. For example, high-frequency load measurements may be used to ensure that tool 22 is operating within its specifications. By way of example, tool 22 may comprise a jarring tool, a mechanical vibration tool, a perforation tool, or another tool which undergoes cyclical loading of one or more cycles.

In a specific embodiment, tool 22 is in the form of a jarring tool which creates an axial impact force rated as a multiple of the load applied to the jar before it actuates (the preload). As discussed above, the axial impact force can be expressed as 2 to 1, 4 to 1, 8 to 1, or another suitable ratio. Sometimes the jarring tool 22 can malfunction due to bad seals, broken springs, or other faulty components. By monitoring the axial load at a high rate in real-time, the peak force may be compared with the preload. The comparison allows control system 40 and/or an operator to determine if the jar tool 22 is performing properly. If the tool 22 is functioning improperly, adjustments may be made to the tool. For example, the rate of cyclical loading may be adjusted or the tool 22 may be pulled to the surface for repair or replacement.

According to another embodiment, tool 22 is in the form of a vibrating tool with a force specification. For example, tool 22 may be a mechanical vibration tool designed to create a nominally sinusoidal axial force. The sinusoidal axial force may be used to extend the reach of coiled tubing into a well, to facilitate movement of the tool as it cuts through a material, and/or to enhance other types of tool movement. The peak force of the vibrating tool 22 is sometimes given as a specification. By measuring the axial force at a high rate in real-time via sensor system 36, the control system 40 and/or an operator may determine if the vibrating tool 22 is operating within its specifications. If not, the cyclical loading may be adjusted or other actions may be taken, e.g. retrieving tool 22 to the surface for repair or replacement.

As described herein, the systems, cyclically loaded tools, sensors, and control systems may be used in a variety of operations, including tool optimization operations, tool protection operations, and tool performance verification operations. Depending on the specifics of a given tool system, operation, and environment, the design of the overall system 20 and of the cyclically loaded tool 22 may vary. Additionally, the control system 40 may be designed to process data from the sensor system 36 and to output helpful data to an operator. However, the control system 40 also may be a processor-based system programmed to automatically control adjustment to the tool 22. For example, based on data obtained from the sensor system 36 (data obtained at a high sampling frequency relative to the frequency of the cyclical loading of the tool 22), many types of automatic adjustments to the tool 22 may be undertaken via control system 40. In some applications, the cyclical loading frequency of the tool may be adjusted to improve operation of the tool. However, other actions may comprise repairing the tool, replacing the tool, and/or other suitable responses to the data obtained from sensor system 36. Sensors 38 also may comprise a variety of sensor types having sample rates higher than the cyclical frequency of the tool 22. By way of example, sensors 38 may comprise load sensors, stress/strain sensors, accelerometers, other types of sensors, or combinations of sensors.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for performing and monitoring an intervention operation within a wellbore, comprising:

providing an intervention assembly for use in the wellbore, the intervention assembly extending from surface equipment as a tool string with at least one telemetry link for providing communication between the surface equipment and the tool string;

disposing the tool string of the intervention assembly into the wellbore;

performing an intervention operation in the wellbore;

monitoring and collecting data at a rate sufficient to evaluate a dynamic load event having a frequency and associated with the intervention operation, the monitoring and collecting related to the intervention operation, and the rate of monitoring and collecting data performed at a frequency of at least about two times the frequency of the dynamic load event; and sending at least a portion of the monitored and collected data to the surface equipment while the intervention operation is being performed.

2. The method as recited in claim 1, wherein providing comprises providing the telemetry link in the form of an electric cable and/or an optical cable.

3. The method as recited in claim 1, wherein providing comprises providing the intervention assembly with coiled tubing to convey the tool string.

4. The method as recited in claim 1, wherein providing comprises providing the intervention assembly with slickline to convey the tool string.

5. The method as recited in claim 1, wherein sending comprises sending the data to a control system located at a surface location.

6. The method as recited in claim 1, further comprising adjusting the intervention operation based on the monitored and collected data.

7. The method as recited in claim 1, further comprising evaluating the monitored and collected data to determine the peak force and/or acceleration of the load event.

8. The method as recited in claim 1, further comprising evaluating the monitored and collected data to determine the frequency of the load event.

9. The method as recited in claim 1, further comprising evaluating the monitored and collected data to determine that the load event has occurred.

10. The method as recited in claim 1, further comprising evaluating the monitored and collected data to verify proper performance of the tool string.

11. The method as recited in claim 1, wherein performing comprises performing a milling operation.

12. The method as recited in claim 1, wherein performing comprises performing a jarring operation.

13. The method as recited in claim 1, wherein performing comprises performing a mechanical vibration operation.

14. The method as recited in claim 1, wherein performing comprises performing a perforating operation.

15. A method for improving operation of a tool, comprising:

operating the tool in a manner which provides a dynamic activity of the tool having a frequency;

sampling the dynamic activity at a frequency greater than the frequency of at least about two times the frequency of the dynamic activity to collect the data on the dynamic activity; and using the data to change the dynamic activity of the tool in a manner which improves operation of the tool, wherein sampling comprises sampling dynamic loading or dynamic acceleration at a frequency at least about two times the frequency of the dynamic loading or dynamic acceleration, respectively.

16. The method as recited in claim 15, wherein operating comprises operating the tool in a well intervention operation.

17. The method as recited in claim 15, wherein sampling the dynamic activity comprises sampling dynamic acceleration at a frequency at least about two times the frequency of the dynamic acceleration.

18. The method as recited in claim 15, wherein using the data comprises using the data to change the dynamic loading of the tool in a manner which increases a rate of penetration of the tool through a material.

19. A system for facilitating an intervention operation in a wellbore, comprising:

a tool operated in a wellbore with a dynamic loading having a frequency;

a sensor sampling the dynamic loading at a frequency rate of at least about two times the frequency of the frequency of the dynamic loading;

a telemetry communication line carrying sensor data from the sensor; and a control system receiving the sensor data, the control system having a processor programmed to process the sensor data to determine whether the cyclical loading is appropriate for a given downhole operation in the wellbore.

* * * * *